US010994955B2

(12) United States Patent
Hwang et al.

(10) Patent No.: US 10,994,955 B2
(45) Date of Patent: May 4, 2021

(54) TRAY UNIT ASSEMBLY

(71) Applicant: HYOSUNG TNS INC., Seoul (KR)

(72) Inventors: Jin Young Hwang, Seoul (KR); Kyoung Soo Kim, Gyeonggi-do (KR); Seung Soo Lee, Gyeonggi-do (KR); Young Dae Seo, Daegu (KR); Hye Bin Oh, Incheon (KR)

(73) Assignee: HYOSUNG TNS INC., Seoul (KR)

( * ) Notice: Subject to any disclaimer, the term of this patent is extended or adjusted under 35 U.S.C. 154(b) by 128 days.

(21) Appl. No.: 16/355,912

(22) Filed: Mar. 18, 2019

(65) Prior Publication Data

US 2019/0291982 A1 Sep. 26, 2019

(30) Foreign Application Priority Data

Mar. 23, 2018 (KR) ..... 10-2018-0033721

(51) Int. Cl.

| | |
|---|---|
| ***B65H 1/26*** | (2006.01) |
| ***B65H 1/08*** | (2006.01) |
| ***B65H 31/30*** | (2006.01) |
| ***B65H 3/06*** | (2006.01) |
| ***G07F 19/00*** | (2006.01) |
| ***G07D 11/13*** | (2019.01) |

(Continued)

(52) U.S. Cl.

CPC ..... *B65H 1/08* (2013.01); *B65H 1/266* (2013.01); *B65H 3/06* (2013.01); *B65H 5/006* (2013.01); *B65H 31/3063* (2013.01); *B65H 83/02* (2013.01); *G07D 11/13* (2019.01); *G07D 11/14* (2019.01); *G07F 19/20* (2013.01); *G07F 19/202* (2013.01); *G07F 19/205* (2013.01); *B65H 2301/4225* (2013.01); *B65H 2701/1912* (2013.01)

(58) Field of Classification Search

CPC . B65H 1/08; B65H 1/14; B65H 1/266; B65H 1/04; B65H 1/06; B65H 2701/1912; B65H 31/3063; G07D 11/13; G07D 11/14; G07D 11/16; G07D 11/12

See application file for complete search history.

(56) References Cited

U.S. PATENT DOCUMENTS 6,454,163 B2 * 9/2002 Peebles ..... G07D 11/14 235/379
6,612,564 B1 * 9/2003 Todd ..... B65H 1/04 206/215

(Continued)

FOREIGN PATENT DOCUMENTS

KR 10-2014-0084535 A 7/2014

*Primary Examiner* — Luis A Gonzalez
(74) *Attorney, Agent, or Firm* — Bacon & Thomas, PLLC

(57) ABSTRACT

A tray unit assembly includes a housing, a separating/stacking unit, a tray unit and an elevating member. The separating/stacking unit includes a separating roller unit and a stacking roller unit provided in the housing. The tray unit is provided to be inserted into the housing and includes a first tray body fixed to the housing when the tray unit is inserted into the housing, and a second tray body connected to the first tray body to be slidable in a vertical direction and having a media stacking space formed therein. The elevating member is disposed to be movable up and down and configured to be in contact with a bottom surface of the second tray body to move the second tray body toward the stacking roller unit or the separating roller unit.

7 Claims, 13 Drawing Sheets

(51) Int. Cl.

| | |
|---|---|
| ***B65H 83/02*** | (2006.01) |
| ***G07D 11/14*** | (2019.01) |
| ***B65H 5/00*** | (2006.01) |

(56) References Cited

U.S. PATENT DOCUMENTS

| | | | | |
|---|---|---|---|---|
| 2012/0256367 | A1* | 10/2012 | Matsushima | B65H 1/14 271/147 |
| 2014/0183817 | A1* | 7/2014 | Hwang | B65H 31/3063 271/306 |
| 2016/0005254 | A1* | 1/2016 | Seroka | G07D 11/12 194/351 |
| 2020/0180895 | A1* | 6/2020 | Hasegawa | B65H 31/18 |

* cited by examiner

TRAY UNIT ASSEMBLY

CROSS-REFERENCE TO RELATED APPLICATION

This application is based on and claims priority from Korean Patent Application No. 10-2018-0033721, filed on Mar. 23, 2018, the disclosure of which is incorporated herein in its entirety by reference for all purposes.

TECHNICAL FIELD

The present disclosure relates to a tray unit assembly.

BACKGROUND

In general, an automated teller machine (ATM) is an automation device that can provide unmanned financial services such as cash/check deposits and withdrawals through the use of a card or a bankbook without bank employees regardless of time or place.

Recently, the use of automated teller machines has been expanding not only in financial institutions such as banks or the like but also in convenience stores, department stores and public places. The automated teller machines may be divided into a withdrawal machine, a deposit machine and a withdrawal/deposit machine depending on whether or not to deposit or withdraw money. In recent years, the automated teller machines have been used for various purposes such as cash deposit/withdrawal, check deposit/withdrawal, bankbook update, fee payment, ticket issuance and the like Among the deposit/withdrawal machines, there is a machine that receives and automatically processes an inputted medium such as cash or check. Such a deposit/withdrawal machine checks the authenticity of the inputted medium and accepts the inputted medium only in the case where inputted medium is normal. In other words, the medium introduced through a deposit/withdrawal unit is authenticated by means of scanning or other methods, and is finally accepted only when there is no abnormality. If there is an abnormality, the medium is returned.

Such a deposit/withdrawal machine requires a tray unit for conveying and separating the medium introduced through the deposit/withdrawal unit. Therefore, there is a need for research on a tray unit capable of conveying media in a more efficient manner.

SUMMARY

Embodiments of the present disclosure provide a tray unit assembly capable of separating and stacking introduced media.

In accordance with an aspect, there is provided a tray unit assembly comprising: a housing; a separating/stacking unit including a separating roller unit and a stacking roller unit provided in the housing; a tray unit provided to be inserted into the housing, the tray unit including a first tray body fixed to the housing when the tray unit is inserted into the housing, and a second tray body connected to the first tray body to be slidable in a vertical direction and having a media stacking space formed therein; and an elevating member disposed to be movable up and down and configured to be in contact with a bottom surface of the second tray body to move the second tray body toward the stacking roller unit or the separating roller unit.

When the elevating member is raised, the second tray body may be connected to the stacking roller unit, and when the elevating member is lowered, the second tray body may be connected to the separating roller unit.

At least one first slit into which at least a part of the separating roller unit is selectively inserted may be formed on a bottom surface of the second tray body, a second slit which communicates with the first slit may be formed in a portion of the elevating member corresponding to each of the at least one first slit, and when the elevating member is lowered, at least a part of the separating roller unit may be inserted into the first slit and the second slit.

Guide grooves extending in a vertical direction may be formed on inner surfaces of both side walls of the first tray body, and guide bosses extending in the vertical direction may be formed on outer surfaces of both side walls of the second tray body and may be fitted in and moved along the guide grooves.

The tray unit may further include a clamping plate slidably connected to the second tray body, and a link driving unit connected to the first tray body and the clamping plate to linearly move the clamping plate in a vertical direction or rotate the clamping plate.

In accordance with another aspect, there is provided a tray unit assembly comprising: a housing; a separating/stacking unit including a separating roller unit and a stacking roller unit provided in the housing; and a tray unit provided to be inserted into the housing, the tray unit having a media stacking space formed therein, wherein the tray unit includes a first tray body configured to horizontally reciprocate between the housing and a deposit/withdrawal unit for receiving an inputted medium, a second tray body vertically movably installed on the first tray body and configured to reciprocate between the separating roller unit and the stacking roller unit, and a clamping plate vertically movably installed on the second tray body, and wherein when the clamping plate is raised, the media stacking space is defined between the clamping plate and the second tray body and, when the clamping plate is lowered, the clamping plate presses media stacked in the media stacking space.

When the second tray body and the clamping plate are lowered, the tray unit may be connected to the separating roller unit and, when the second tray body and the clamping plate are raised, the tray unit may be connected to the stacking roller unit.

The tray unit assembly may further comprise: an elevating member disposed to be movable up and down, wherein the second tray body is moved up and down in conjunction with the elevating member.

The tray unit assembly may further comprise: a link driving unit installed at the first tray body and configured to move up and down the clamping plate.

The tray unit assembly according to one embodiment of the present disclosure can easily convey, separate and stack introduced media.

DETAILED DESCRIPTION

Figure 1:
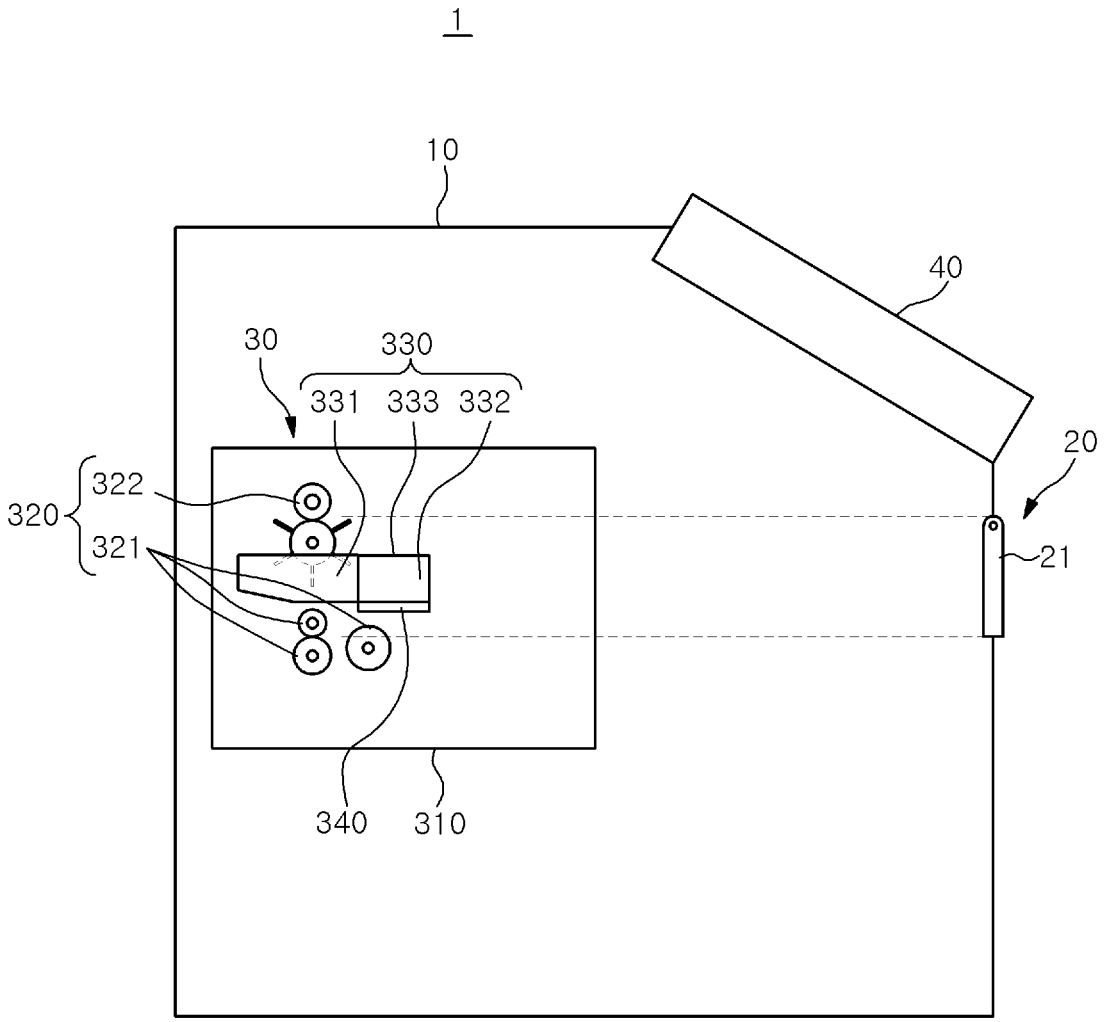
FIG. 1 is a configuration diagram of an automated teller machine according to an embodiment of the present disclosure.

Hereinafter, configurations and operations of embodiments will be described in detail with reference to the accompanying drawings. The following description is one of various patentable aspects of the present disclosure and may form a part of the detailed description of the present disclosure.

However, in describing the present disclosure, detailed descriptions of known configurations or functions that make the present disclosure obscure may be omitted.

The present disclosure may be modified and include various embodiments. Specific embodiments will be exemplarily illustrated in the drawings and described in the detailed description of the embodiments. However, it should be understood that they are not intended to limit the present disclosure to specific embodiments but rather to cover all modifications, similarities, and alternatives that are included in the spirit and scope of the present disclosure.

The terms used herein, including ordinal numbers such as "first" and "second" may be used to describe, and not to limit, various components. The terms simply distinguish the components from one another.

When it is said that a component is "connected" or "linked" to another component, it should be understood that the former component may be directly connected or linked to the latter component or a third component may be interposed between the two components.

Specific terms in the present disclosure are used simply to describe specific embodiments without limiting the present disclosure. An expression used in the singular encompasses the expression of the plural, unless it has a clearly different meaning in the context.

FIG. 1 is a schematic configuration diagram of an automated teller machine 1 according to an embodiment of the present disclosure. Referring to FIG. 1, the automated teller machine 1 according to an embodiment of the present disclosure may include a main body 10 constituting an outer shape, a deposit/withdrawal unit 20 provided on one side of the main body 10 and provided to receive an inputted medium, and a tray unit assembly 30 configured to convey, separate and stack the medium supplied to the deposit/withdrawal unit 20. The expression "includes (including) the above-listed components" in the embodiment of the present disclosure does not mean that the embodiment of the present disclosure consists of only these components, but means that the embodiment of the present disclosure basically includes these components. The embodiment of the present disclosure may further include other components (components well-known in the field of the automated teller machine, e.g., a discrimination unit connected to the above-described components via a conveyance path to discriminate the medium, a temporary storage unit configured to temporarily store the medium, a storage cassette configured to store the medium, and the like). However, the well-known components will not be described in detail because such a description may obscure the gist of the present disclosure.

The main body 10 may constitute the external shape of the automated teller machine 1. The deposit/withdrawal unit 20 may be provided on one side of the main body 10. The deposit/withdrawal unit 20 may be provided to receive an inputted medium such as a bill or a check. The deposit/withdrawal unit 20 may be provided in front of the main body 10 to facilitate the deposit or withdrawal.

The deposit/withdrawal unit 20 may be provided with a deposit/withdrawal shutter 21 so that the medium can be inserted into or discharged from the automated teller machine 1. The deposit/withdrawal shutter 21 may be opened or closed by an external control signal.

The main body 10 may be provided with a display unit 40. The display unit 40 may be provided so that a customer can visually confirm the deposit/withdrawal state. For example, the display unit 40 may be provided at a front upper portion of the main body 10.

Meanwhile, the tray unit assembly 30 may be provided in the main body 10. The tray unit assembly 30 may convey, separate and store the medium introduced through the deposit/withdrawal unit 20, or may discharge the medium to the deposit/withdrawal unit 20. Hereinafter, the detailed configuration of the tray unit assembly 30 will be described.

Figure 2:
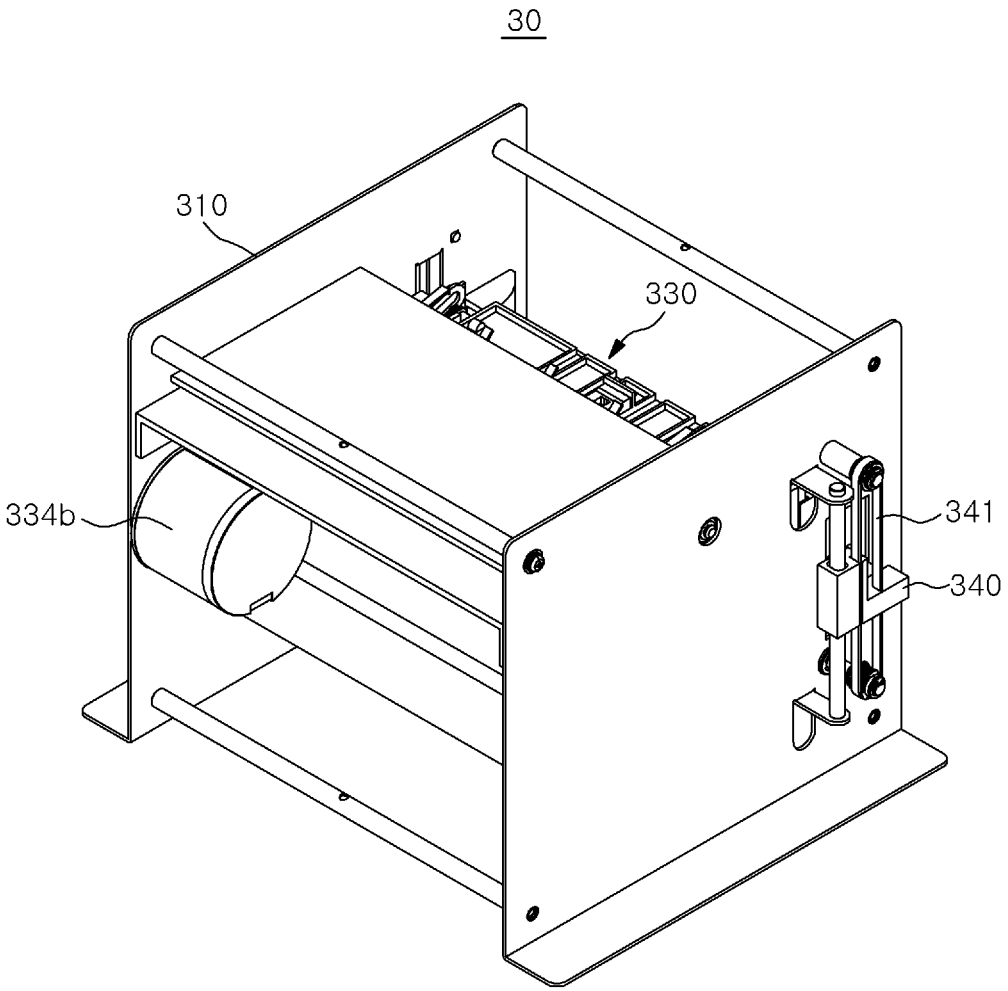
FIG. 2 is a perspective view of a tray unit assembly according to the embodiment of the present disclosure.

FIG. 2 is a perspective view of the tray unit assembly 30 according to the embodiment of the present disclosure.

Figure 3:
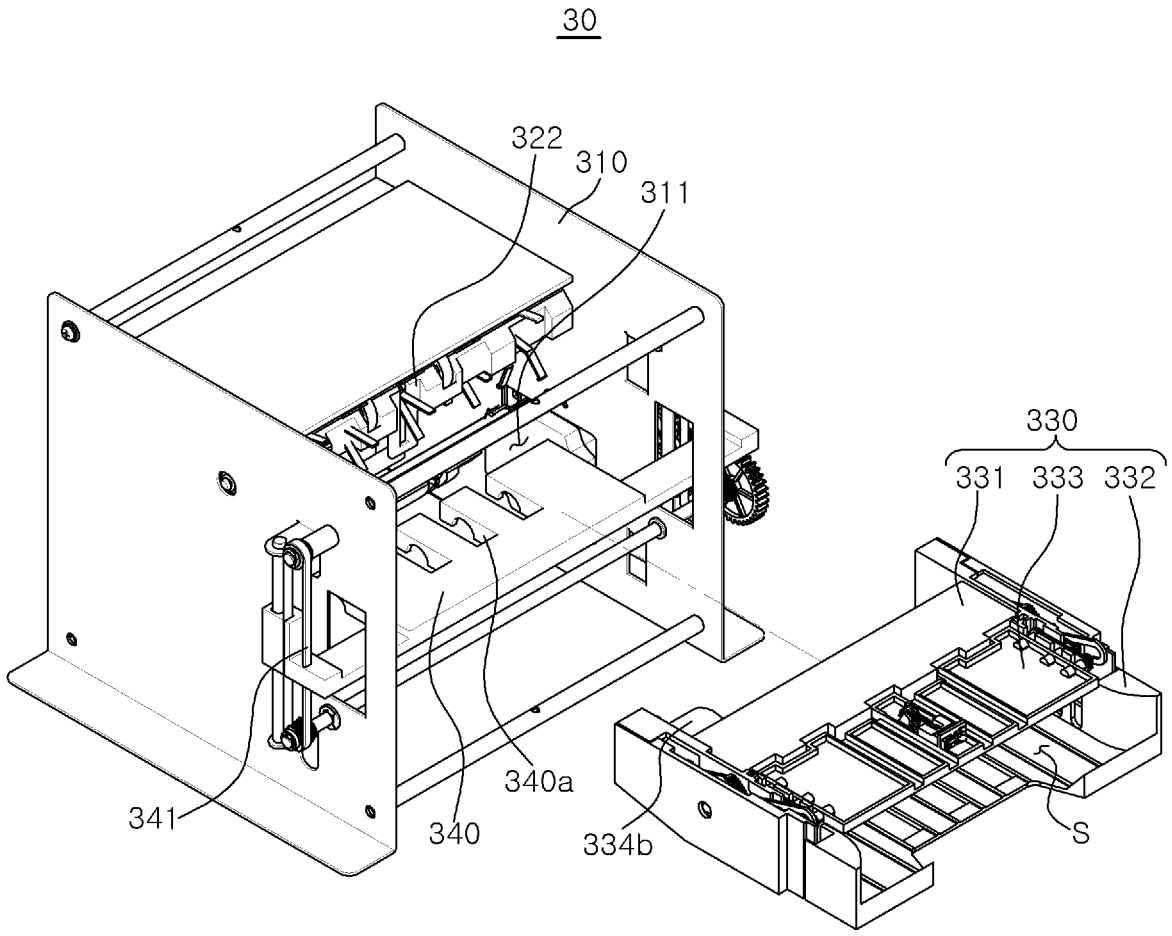
FIG. 3 is a perspective view showing the tray unit detached from a housing of a tray unit assembly according to the embodiment of the present disclosure.

FIG. 3 is a perspective view showing a tray unit 330 detached from a housing 310 of the tray unit assembly 30 according to the embodiment of the present disclosure.

Referring FIGS. 1 to 3, the tray unit assembly 30 according to the embodiment of the present disclosure may include: a housing 310; a separating/stacking unit 320 including a separating roller unit 321 provided on one side in the housing 310 and a stacking roller unit 322 disposed on the other side in the housing 310; a tray unit 330 provided so as to be inserted into the housing 310 and having a media stacking space S formed therein; and an elevating member 340 disposed on a bottom of the tray unit 330 so as to be movable up and down.

The housing 310 may be provided inside the main body 10 and may define the external shape of the tray unit assembly 30. The housing 310 may be provided with a tray unit insertion portion 311 into which the tray unit 330 is inserted. The tray unit 330 may be inserted into the tray unit insertion portion 311, and the media accommodated in the tray unit 330 may be separated or stacked in a state where the tray unit 330 is inserted. In addition, when the tray unit 330 is inserted, the medium to be withdrawn from a separate cassette module (not shown) may be introduced into the media stacking space S of the tray unit 330. The housing 310 may be provided with the separating roller unit 321 and the stacking roller unit 322. The separating roller unit 321 may be provided to separate the medium conveyed by the tray unit 330, and may be disposed at one side in the housing 310, for example, at a lower side in the housing 310. The separating roller unit 321 may separate the media stored in the tray unit 330 one by one and may convey the media to another place. For example, the separating roller unit 321 may convey the medium to a discrimination unit (not shown).

The stacking roller unit 322 may be provided to stack a part of the media separated from the separating roller unit 321 or a medium conveyed for withdrawal in the tray unit 330. The stacking roller unit 322 may be disposed at the other side in the housing 310, for example, at an upper side in the housing 310. The stacking roller unit 322 may stack a part of the media separated by the separating roller unit 321 or the medium conveyed for withdrawal. For example, the separating roller unit 321 may convey to the tray unit 330 a rejected medium, which has been discriminated as an abnormal medium while passing through a discrimination unit (not shown), among the media separated by the separating roller unit 321, or may convey to the tray unit 330 a medium withdrawn from a separate cassette module (not shown) that stores media.

Figure 4:
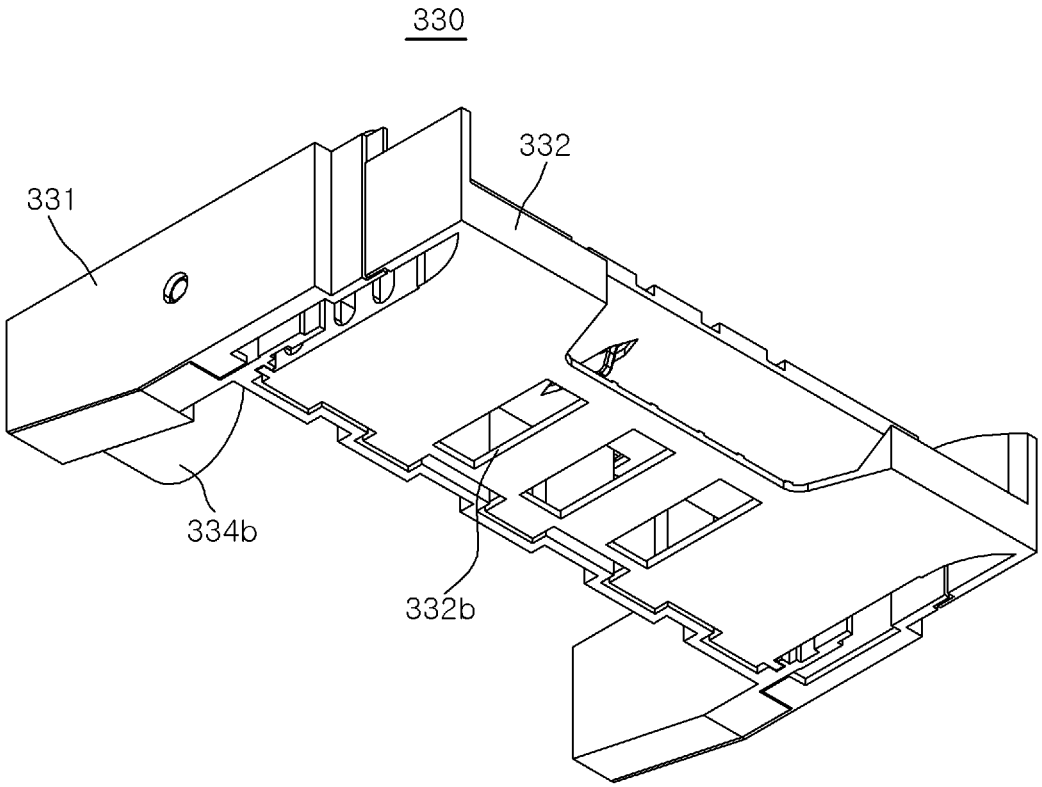
FIG. 4 is a bottom perspective view of the tray unit according to the embodiment of the present disclosure.
Figure 5:
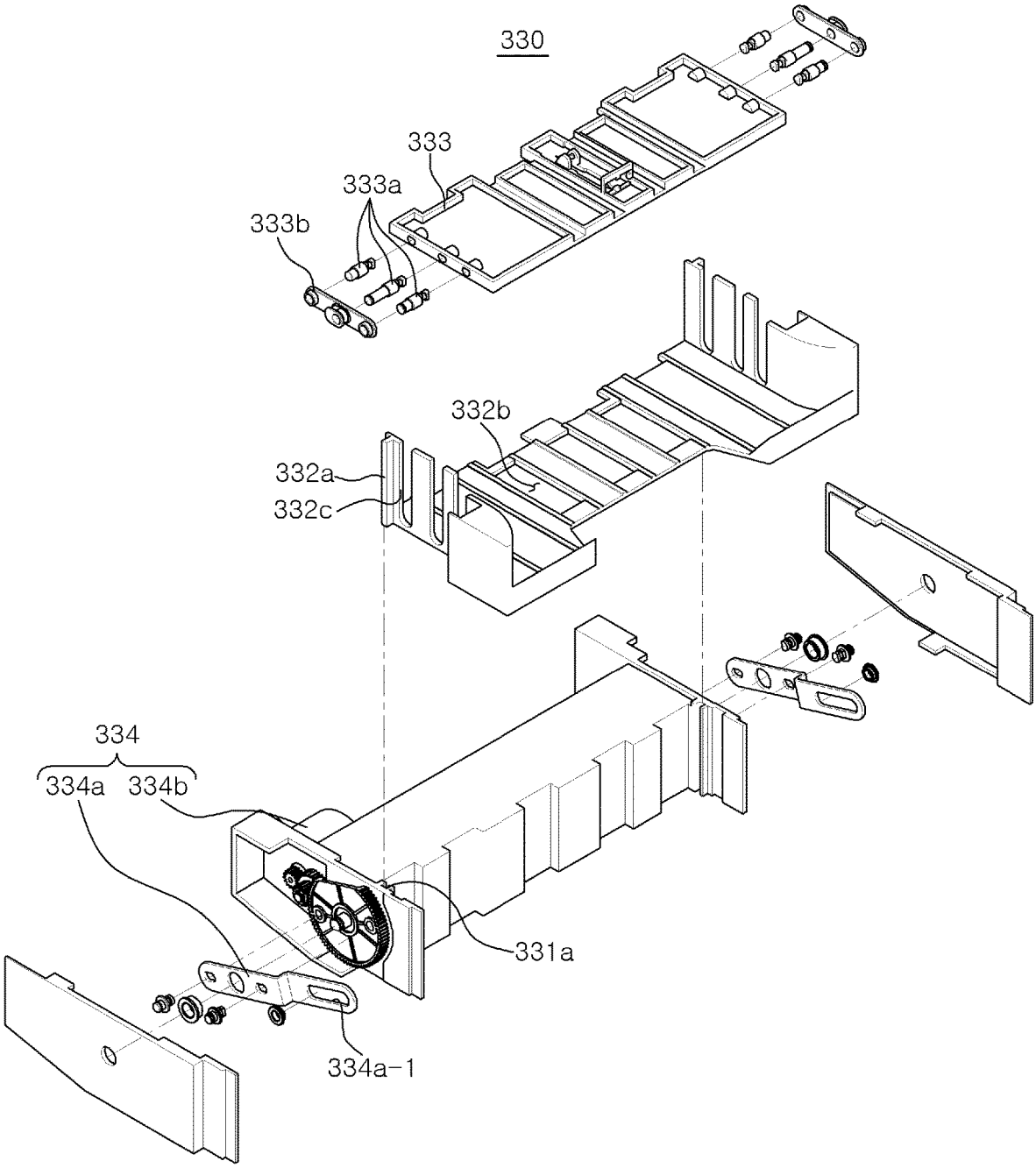
FIG. 5 is an exploded perspective view of the tray unit according to the embodiment of the present disclosure.
Figure 6:
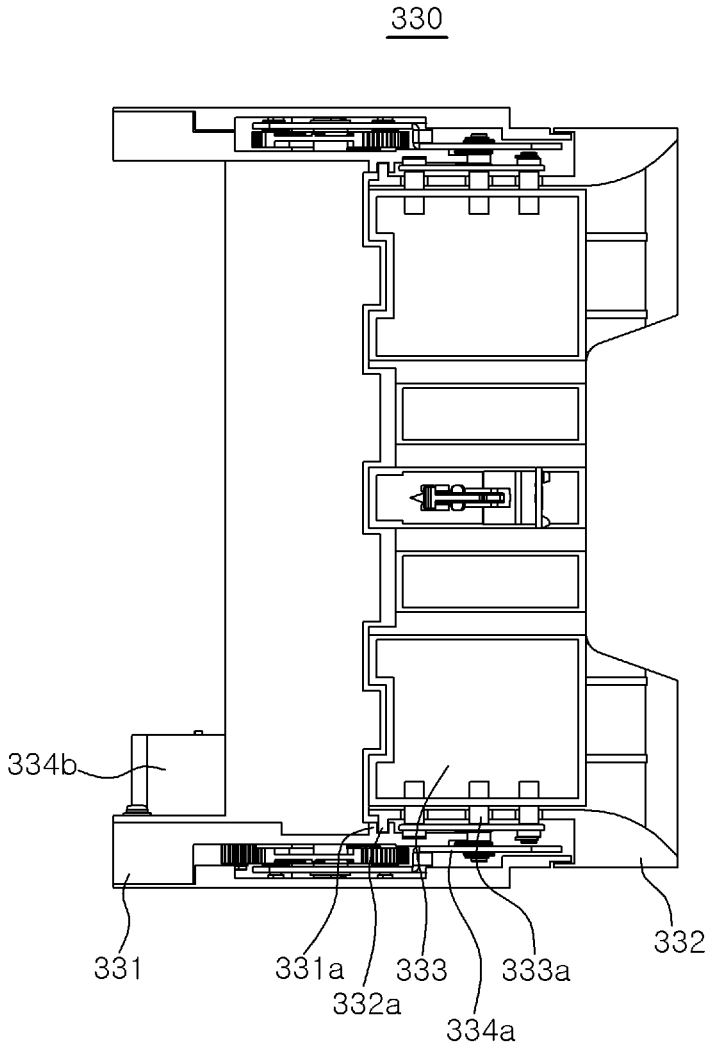
FIG. 6 is a plan view of the tray unit according to the embodiment of the present disclosure.

Referring to FIGS. 4 to 6, the tray unit 330 may be provided to convey a medium. The tray unit 330 may convey a medium while reciprocating between the deposit/withdrawal unit 20 and the housing 310. For example, the tray unit 330 may receive a medium from a customer at the deposit/withdrawal unit 20 and may move to the housing 310 to separate and stack the medium. Furthermore, the tray unit 330 may receive a withdrawal target medium from the housing 310 and may convey the medium to the deposit/withdrawal unit 20 to allow the customer to take the medium.

The tray unit 330 may be fixed to the housing 310, for example, when the tray unit 330 is inserted into the housing 310. The tray unit 330 may include: a first tray body 331 configured to horizontally reciprocate between the housing 310 and the deposit/withdrawal unit 20 for reception of an inputted medium; a second tray body 332 connected to the first tray body 331 so as to be slidable in a vertical direction and having a media stacking space S formed therein; a clamping plate 333 slidably connected to the second tray body 332; and a link driving unit 334 connected to the first tray body 331 and the clamping plate 333 to linearly move the clamping plate 333 in a vertical direction or rotate the clamping plate 333.

The second tray body 332 may be coupled to the first tray body 331 so as to be slidable in the vertical direction. For example, vertically extending guide grooves 331*a* may be formed on the inner surfaces of both side walls of the first tray body 331, and vertically extending guide bosses 332*a* may be provided on the outer surfaces of both side walls of the second tray body 332. The guide bosses 332*a* may be fitted in and moved along the respective guide grooves 331*a*. The second tray body 332 may move up and down with respect to the first tray body 331 in a state in which the guide bosses 332*a* are inserted into the guide groove 331*a*. Accordingly, when the tray unit 330 is inserted into the tray unit insertion portion 311 of the housing 310, the first tray body 331 may be fixed to the tray unit insertion portion 311 and the second tray body 332 may move up and down.

A first slit 332*b* may be formed on the bottom surface of the second tray body 332. At least a part of the separating roller unit 321 may be inserted into the first slit 332*b* to make contact with the medium accommodated in the second tray body 332.

The clamping plate 333 may be slidably connected to the second tray body 332. For example, at least one guide slit 332*c* having a linear shape in the vertical direction may be formed on each of both side walls of the second tray body 332, and at least one guide protrusion 333*a* inserted into the guide slit 332*c* may be provided on each of both side portions of the clamping plate 333. Furthermore, the guide protrusion 333*a* may be rotatably connected to the clamping plate 333. When the clamping plate 333 moves in a state in which the guide protrusion 333*a* is inserted into the guide slit 332*c*, the clamping plate 333 may linearly move in the vertical direction along the guide slit 332*c*. At this time, if the guide protrusion 333*a* of the clamping plate 333 is disengaged from the guide slit 332*c*, the clamping plate 333 may make rotational movement. A detailed description thereof will be made later.

The clamping plate 333 may be raised or lowered or rotated in conjunction with the link driving unit 334. In other words, the link driving unit 334 may be provided to linearly move or rotate the clamping plate 333. The link driving part 334 and the guide protrusion 333*a* of the clamping plate 333 may be connected to each other. For example, the guide protrusion 333*a* of the clamping plate 333 may be rotatably connected to a connector 333*b*, and the connector 333*b* may be connected to the link driving unit 334.

The guide protrusion 333*a* of the clamping plate 333 may protrude outside the second tray body 332. The connector 333*b* may be connected to the protruding end of the guide protrusion 333*a*. At this time, the connector 333*b* may be pivotally connected to the link driving unit 334.

The link driving unit 334 may include, for example, a rod 334*a* having a slot 334*a*-1 into which the connector 333*b* is inserted to rotate and slide; and an actuator 334*b* coupled to the first tray body 331 and engaged with the rod 334*a* through gears to rotate the rod 334*a*.

Meanwhile, the elevating member 340 may be provided inside the housing 310. For example, the elevating member 340 may be disposed at the bottom of the tray unit 330. The second tray body 332 may be raised and lowered in conjunction with the elevating member 340. In other words, the elevating member 340 may make contact with the bottom surface of the second tray body 332 of the tray unit 330 to move the second tray body 332 toward the separating roller unit 321 or the stacking roller unit 322. For example, the elevating member 340 may be connected to a driving power source 341 such as a belt or the like and may be raised or lowered.

The elevating member 340 may be moved downward to connect the second tray body 332 to the separating roller unit 321, or may be moved upward to connect the second tray body 332 to the stacking roller unit 322. As used herein, the expression "the second tray body 332 is connected to the separating roller unit 321 or the stacking roller unit 322 of the separating/stacking unit 320" means a state in which the medium staked in the second tray body 332 can move to the outside through the separating/stacking unit 320, or a state in which an external medium can move to the second tray body 332 through the stacking roller unit 322.

A second slit 340*a* may be formed in a part of the elevating member 340 corresponding to the first slit 332*b* in a shape corresponding to the first slit 332*b*. Therefore, when the tray unit 330 is seated on the elevating member 340, the first slit 332*b* and the second slit 340*a* may communicate with each other. In addition, when the elevating member 340 is moved down, at least a part of the separating roller unit 321 is inserted into the space defined by the first slit 332*b* and the second slit 340*a* to make contact with the medium stacked in the media stacking space S of the second tray body 332.

Hereinafter, an operating process of the clamping plate 333 and a driving process of the second tray body 332 in the tray unit assembly 30 according to the embodiment of the present disclosure will be described. In the following description, the clockwise direction, the counterclockwise direction, the left direction and the right direction are defined with reference to the illustration in the drawings.

Figure 7A:
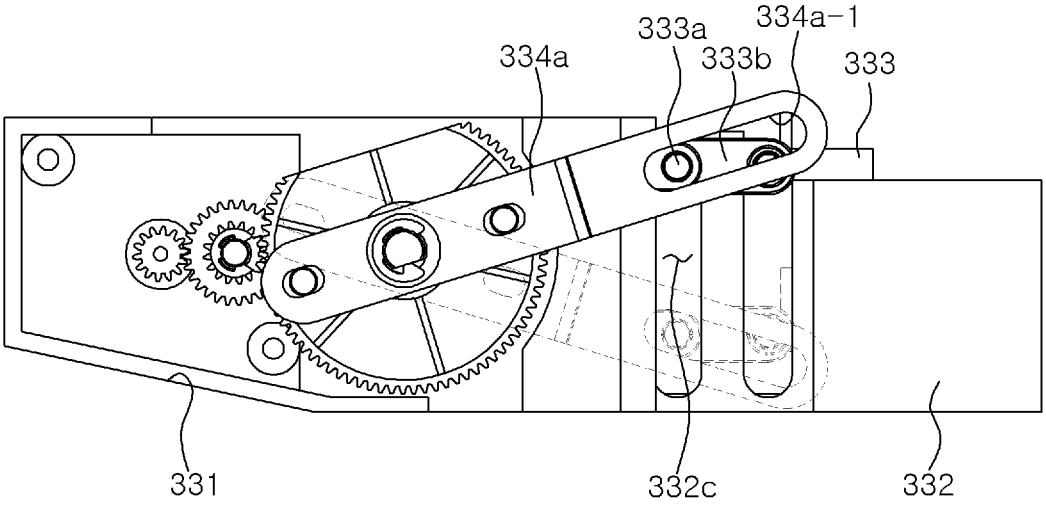
FIGS. 7A and 7B are schematic side sectional views showing the states in which a clamping plate is moved in the tray unit according to the embodiment of the present disclosure.
Figure 7B:
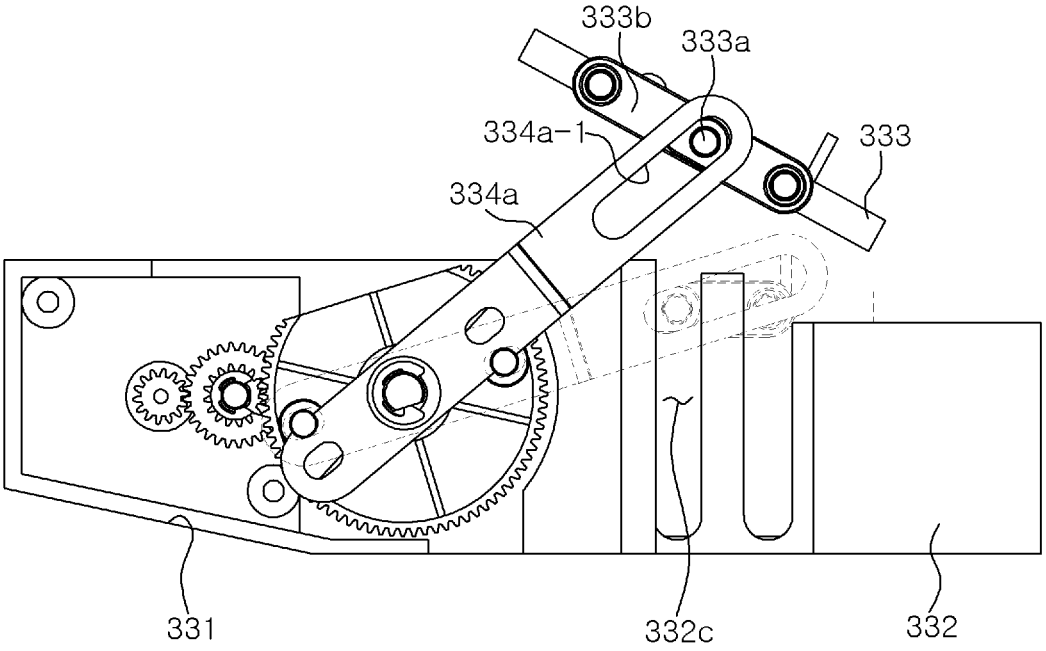

FIGS. 7A and 7B are schematic side sectional views showing the states in which the clamping plate 333 is moved in the tray unit 330 according to the embodiment of the present disclosure.

Referring to FIG. 7A, when the actuator 334*b* rotates the rod 334*a* counterclockwise, the clamping plate 333 moves upward due to the rotation of the rod 334*a*. At this time, the clamping plate 333 linearly moves upward because the guide protrusion 333*a* of the clamping plate 333 is guided along the guide slit 332*c*. Referring to FIG. 7B, when the rod 334*a* continuously rotates and the guide protrusion 333*a* gets out of the guide slit 332*c*, the right end of the clamping plate 333 comes into engagement with a separate stopper (not shown) so that the upward movement thereof is limited. Thus, only the left end of the clamping plate 333 can move upward. Accordingly, the clamping plate 333 may be rotated clockwise to be inclined.

The upward linear movement and the rotational movement of the clamping plate 333 may be performed when the tray unit 330 is inserted into the tray unit insertion portion 311. When the upward linear movement and the rotational movement of the clamping plate 333 are completed, the clamping plate 333 may function as a guide plate so that the medium introduced through the stacking roller unit 322 is not dispersed.

On the other hand, the rotational movement and the downward linear movement of the clamping plate 333 may be performed in the reverse order of the above-described driving operation, and may be performed before the tray unit 330 reciprocates. In other words, the tray unit 330 may reciprocate between the deposit/withdrawal unit 20 and the housing 310 to convey the medium. During the movement of the tray unit 330, it is necessary to fix the medium stacked on the tray unit 330.

Therefore, by lowering the clamping plate 333 and bringing it into contact with the medium, it is possible to fix the medium during the movement of the tray unit 330.

Figure 8A:
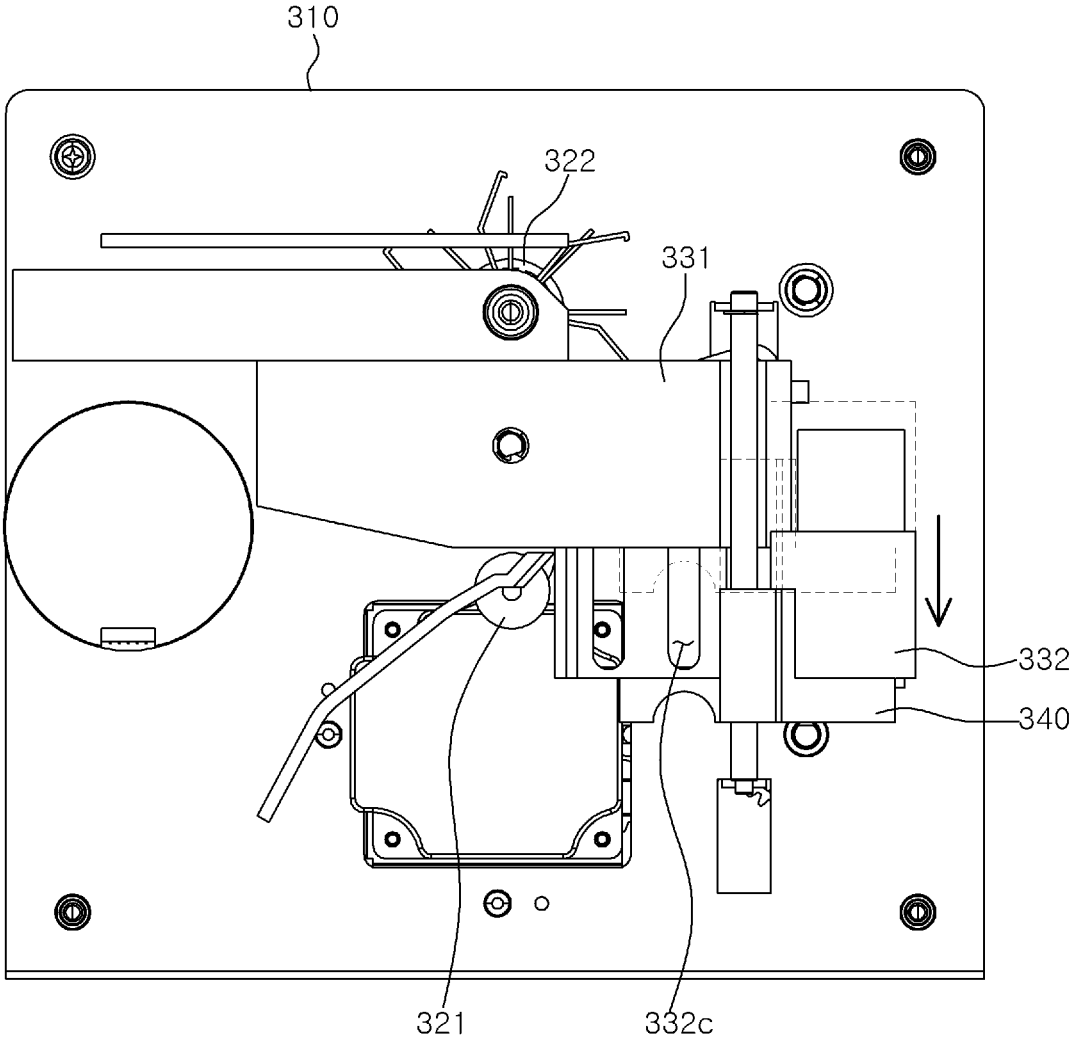
FIGS. 8A and 8B are schematic side sectional views showing the states in which a second tray body of the tray unit according to the embodiment of the present disclosure is moved by an elevating member.
Figure 8B:
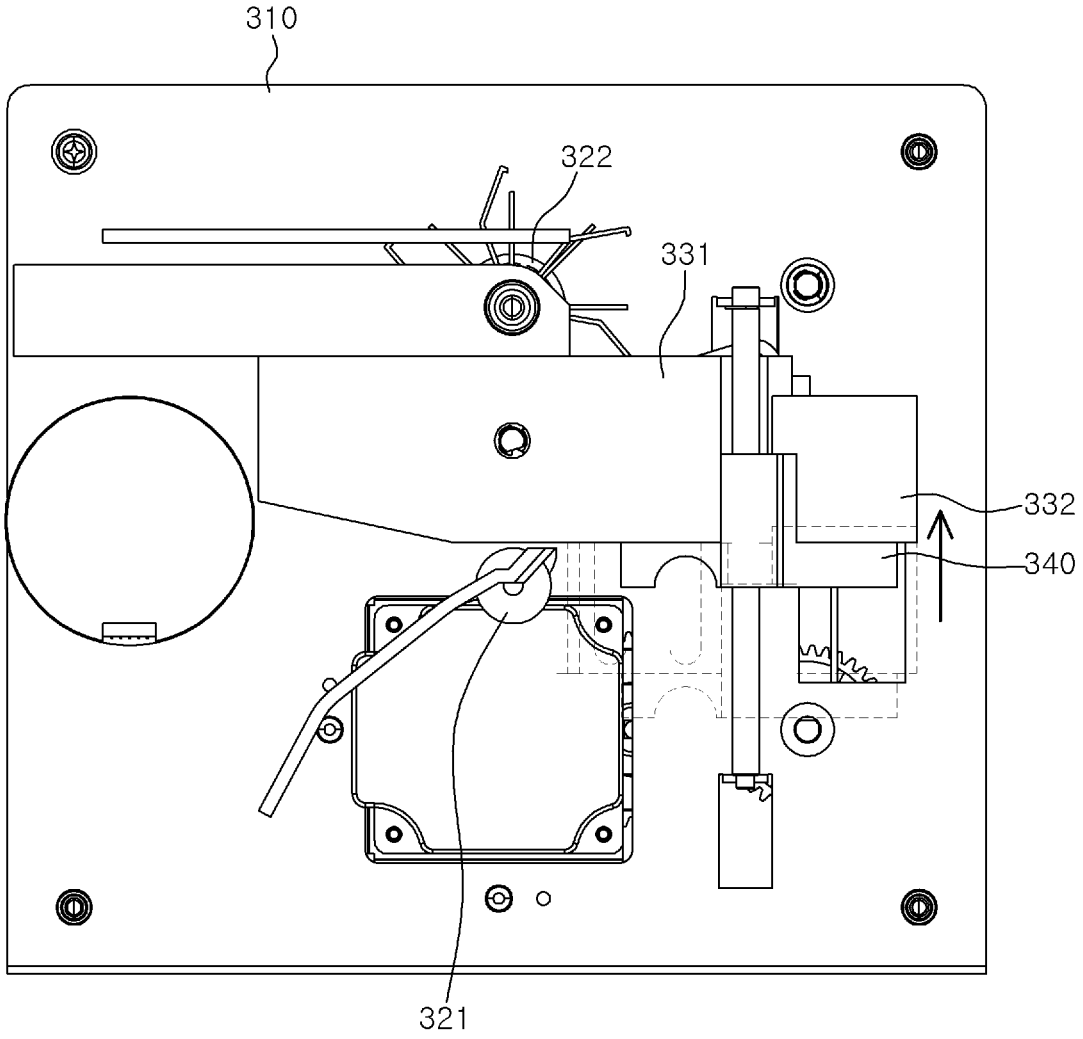

FIGS. 8A and 8B are schematic side sectional views showing the states in which the second tray body 332 of the tray unit 330 according to the embodiment of the present disclosure is moved by the elevating member 340. Referring to FIG. 8A, when the elevating member 340 is lowered, the second tray body 332 may be moved downward while being seated on the elevating member 340. Then, if the lowering of the elevating member 340 is completed, the second tray body 332 may be connected to the separating roller unit 321. The expression "the second tray body 332 is connected to the separating roller unit 321 means that the medium accommodated in the media stacking space S of the second tray body 332 can be conveyed to the outside by the separating roller unit 321. When the elevating member 340 is lowered together with the second tray body 332, at least a part of the separating roller unit 321 is inserted into the first slit 332*b* and the second slit 340*a* so as to make contact with the medium in the media stacking space S.

Referring to FIG. 8B, when the elevating member 340 is raised, the second tray body 332 may move upward while being seated on the elevating member 340. When the elevating member 340 is raised so that the first tray body 331 and the second tray body 332 are aligned with each other, the tray unit 330 may be moved toward the deposit/withdrawal unit 20.

Figure 9A:
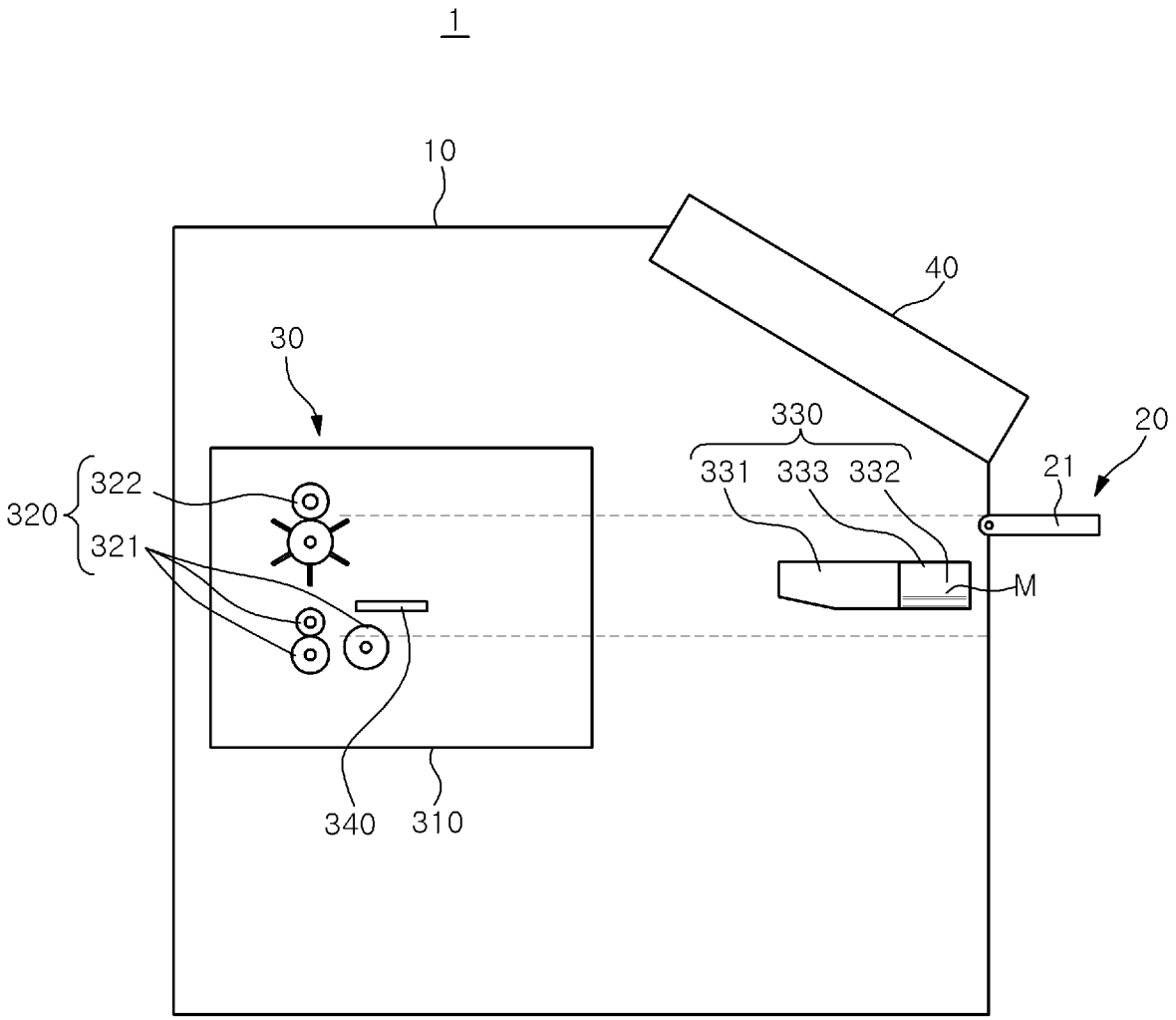
FIGS. 9A to 9C are schematic configuration diagrams showing the states in which a medium is deposited, separated and stacked in the automated teller machine according to the embodiment of the present disclosure.
Figure 9B:
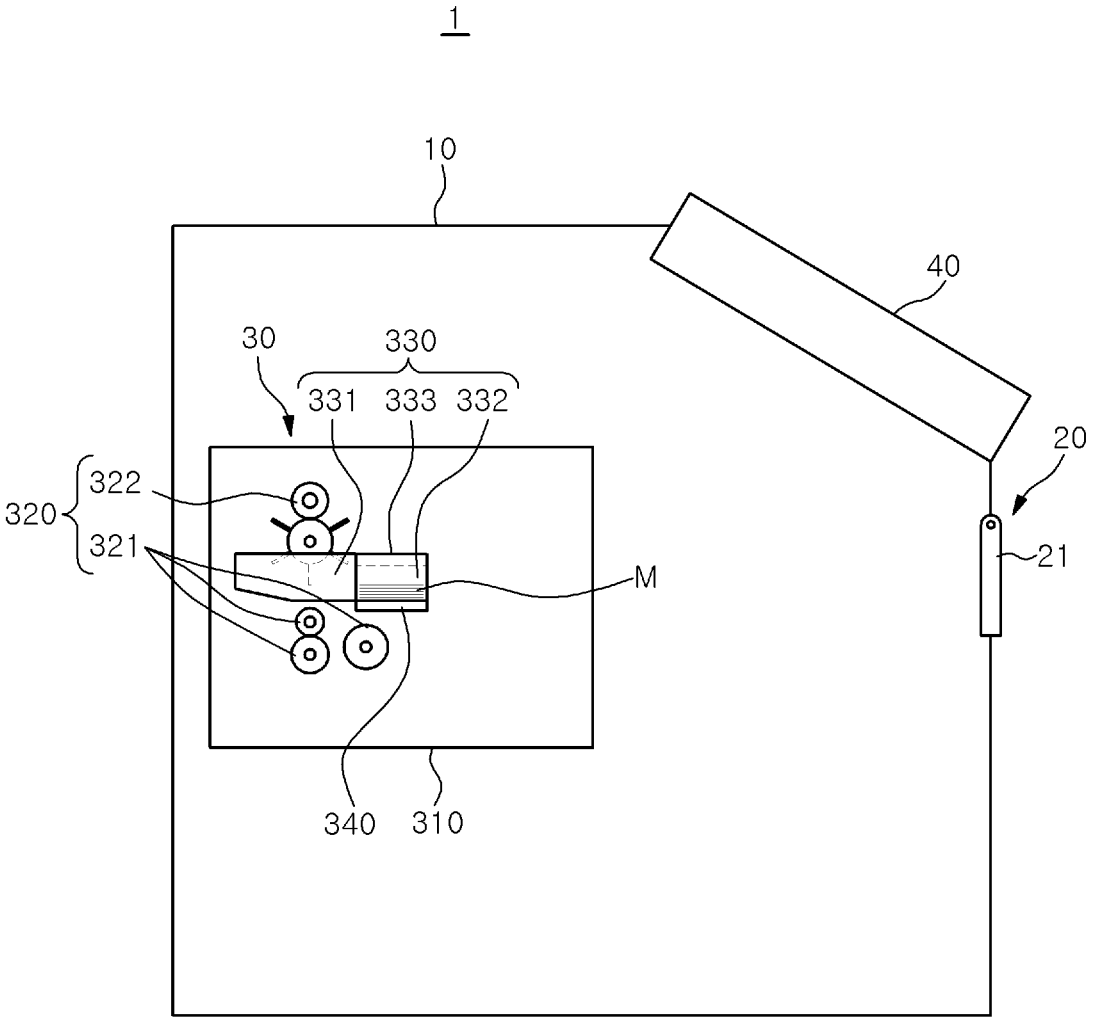
Figure 9C:
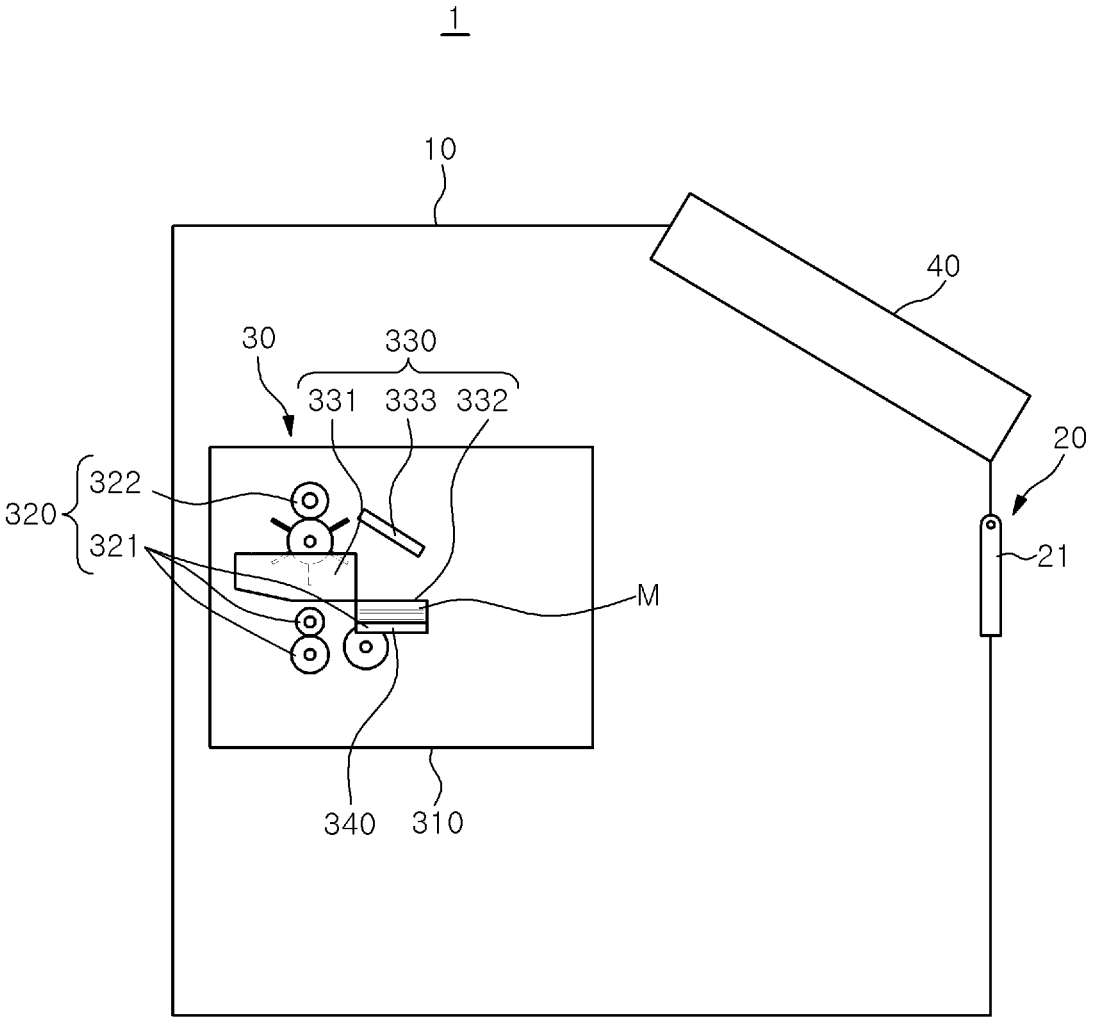

FIGS. 9A to 9C are schematic configuration diagrams showing the states in which the medium is deposited, separated and stacked in the automated teller machine 1 according to the embodiment of the present disclosure.

Referring to FIG. 9A, the tray unit 330 may receive a medium M from the customer at the deposit/withdrawal unit 20. Referring to FIG. 9B, the tray unit 330 supplied with the medium M may be moved toward and inserted into the housing 310. Referring to FIG. 9C, when the insertion of the tray unit 330 is completed, the clamping plate 333 may be rotated upward. The second tray body 332 may be lowered by the elevating member 340 and may be connected to the separating roller unit 321. Subsequently, the medium M in the second tray body 332 may be conveyed in contact with the separating roller unit 321.

While the present disclosure has been described above using the preferred embodiments, the scope of the present disclosure is not limited to the specific embodiments described above. A person having ordinary knowledge in the relevant technical field will be able to replace or modify the constituent elements. Such replacement or modification should be construed to fall within the scope of the present disclosure.

What is claimed is:

1. A tray unit assembly, comprising:

a housing;

a separating/stacking unit including a separating roller unit and a stacking roller unit provided in the housing;

a tray unit provided to be inserted into the housing, the tray unit including a first tray body fixed to the housing when the tray unit is inserted into the housing, and a second tray body connected to the first tray body to be slidable in a vertical direction and having a media stacking space formed therein; and an elevating member disposed to be movable up and down and configured to be in contact with a bottom surface of the second tray body to move the second tray body toward the stacking roller unit or the separating roller unit, wherein when the elevating member is raised, the second tray body is connected to the stacking roller unit, and when the elevating member is lowered, the second tray body is connected to the separating roller unit, and wherein at least one first slit into which at least a part of the separating roller unit is selectively inserted is formed on a bottom surface of the second tray body, a second slit which communicates with the first slit is formed in a portion of the elevating member corresponding to each of the at least one first slit, and when the elevating member is lowered, at least a part of the separating roller unit is inserted into the first slit and the second slit.

2. The tray unit assembly of claim 1, wherein guide grooves extending in a vertical direction are formed on inner surfaces of both side walls of the first tray body, and guide bosses extending in the vertical direction are formed on outer surfaces of both side walls of the second tray body and are fitted in and moved along the guide grooves.

3. A tray unit assembly, comprising:

a housing;

a separating/stacking unit including a separating roller unit and a stacking roller unit provided in the housing;

a tray unit provided to be inserted into the housing, the tray unit including a first tray body fixed to the housing when the tray unit is inserted into the housing, and a second tray body connected to the first tray body to be slidable in a vertical direction and having a media stacking space formed therein; and an elevating member disposed to be movable up and down and configured to be in contact with a bottom surface of the second tray body to move the second tray body toward the stacking roller unit or the separating roller unit, wherein the tray unit further includes a clamping plate slidably connected to the second tray body, and a link driving unit connected to the first tray body and the clamping plate to linearly move the clamping plate in a vertical direction or rotate the clamping plate.

4. A tray unit assembly, comprising:

a housing;

a separating/stacking unit including a separating roller unit and a stacking roller unit provided in the housing; and a tray unit provided to be inserted into the housing, the tray unit having a media stacking space formed therein, wherein the tray unit includes a first tray body configured to horizontally reciprocate between the housing and a deposit/withdrawal unit for receiving an inputted medium, a second tray body vertically movably installed on the first tray body and configured to reciprocate between the separating roller unit and the stacking roller unit, and a clamping plate vertically movably installed on the second tray body, and wherein when the clamping plate is raised, the media stacking space is defined between the clamping plate and the second tray body and, when the clamping plate is lowered, the clamping plate presses media stacked in the media stacking space.

5. The tray unit assembly of claim 4, wherein when the second tray body and the clamping plate are lowered, the tray unit is connected to the separating roller unit and, when the second tray body and the clamping plate are raised, the tray unit is connected to the stacking roller unit.

6. The tray unit assembly of claim 4, further comprising:

an elevating member disposed to be movable up and down, wherein the second tray body is moved up and down in conjunction with the elevating member.

7. The tray unit assembly of claim 4, further comprising:

a link driving unit installed at the first tray body and configured to move up and down the clamping plate.

* * * * *